United States Patent [19]

Salice

[11] Patent Number: 4,785,497

[45] Date of Patent: Nov. 22, 1988

[54] BASE PLATE ASSEMBLY FOR MOUNTING A HINGE BRACKET OF A FURNITURE HINGE OR THE LIKE

[75] Inventor: Luciano Salice, Carimate, Italy

[73] Assignee: Arturo Salice, Novedrate, Italy

[21] Appl. No.: 17,448

[22] Filed: Feb. 24, 1987

[30] Foreign Application Priority Data

Feb. 24, 1986 [DE] Fed. Rep. of Germany ..... 3605902

[51] Int. Cl.[4] ..... E05D 7/04

[52] U.S. Cl. ..... 16/237; 16/370; 16/383; 16/DIG. 43

[58] Field of Search ..... 16/237, 238, 242, 243, 16/245, 246, 248, 288, 302, 370, 382, 383

[56] References Cited

U.S. PATENT DOCUMENTS 4,091,499 5/1978 Lautenschlager ..... 16/242

FOREIGN PATENT DOCUMENTS 3022440 1/1981 Fed. Rep. of Germany ..... 16/382

*Primary Examiner*—Fred A. Silverberg

*Attorney, Agent, or Firm*—Fleit, Jacobson, Cohn & Price

[57] ABSTRACT

A baseplate assembly for mounting a hinge bracket of a furniture hinge has a base plate, which is to be secured to a carrying wall or the like by fixing screws, and a cover plate, which covers or partly overlaps the base plate and is guided on the base plate transversely to the hinge bracket. The hinge bracket, which is connected to the base plate by a retaining screw or rivet and by a headed clamp screw, which is screwed into a tapped bore in the base plate and extends through a slot that is formed in the cover plate and is parallel to the direction in which the cover plate is guided on the base plate.

15 Claims, 4 Drawing Sheets

Fig.7
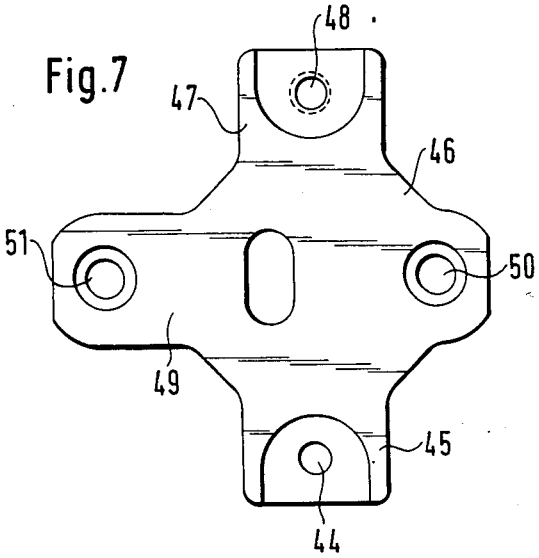
Fig.8
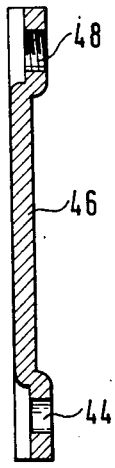
Fig.10
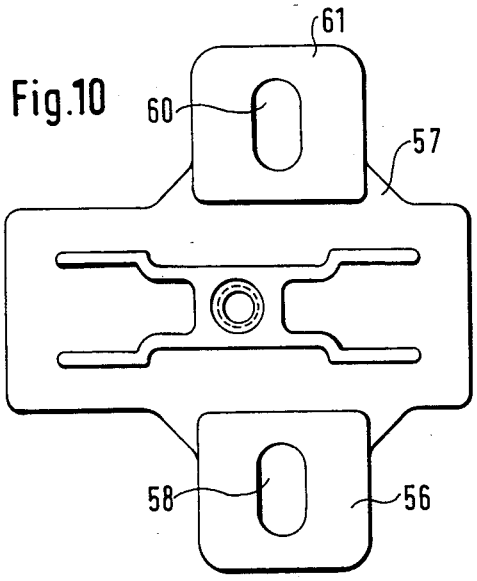
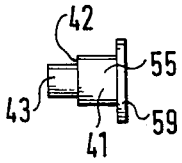
Fig.9

BASE PLATE ASSEMBLY FOR MOUNTING A HINGE BRACKET OF A FURNITURE HINGE OR THE LIKE

BACKGROUND OF THE INVENTION

1. Field of the Invention

This invention relates to a base plate assembly for mounting a hinge bracket of a furniture hinge or the like, which base plate assembly comprises a base plate, which is adapted to be secured to a carrying wall or the like by fixing screws or plugs, and a cover plate, which covers or partly overlaps the base plate and is guided on the same transversely to the hinge bracket or the like and provided with means for fixing the hinge bracket, which is connected to the base plate by retaining means and by a headed clamp screw, which is screwed into a tapped bore in the base plate and extends through a slot that is formed in the cover plate and is parallel to the direction in which the cover plate is guided on the base plate.

2. Description of the Prior Art

A base plate assembly of that kind is known from Published German Application No. 30 22 440 and particularly permits a vertical adjustment of the hinge bracket relative to the furniture. That known base plate assembly comprises a base plate, which is provided on one side with mutually opposite projecting ribs, and a cover plate, which is formed on one side with grooves and is adapted to be mounted on said base plate so that said ribs are slidably received by said grooves. On the other side, the cover plate is formed with a slot for receiving a clamp screw for locking the cover plate against a displacement. That clamp screw is screwed into a tapped bore of the baseplate and prevents a shifting of the cover plate. That known base plate assembly is unduly complicated because the base plate as well as the cover plate must be provided on one side with mating guide means which permit said plates to be laterally displaced relative to each other.

Various base plate assemblies are known which serve to mount hinge brackets or the like and consist of pressure die castings made of a zinc alloy known as Zamak. The cover plate of said base plate assemblies is formed with a rectangular groove, which extends across the intermediate portion of the cover plate into huglike lateral extensions which cover the base plate. The intermediate portion of the cover plate serves to mount the hinge bracket. The base plate extends in said groove and guides the cover plate in that the side edges of the base plate are in sliding contact with the side faces of said groove. Base plates and cover plates consisting of pressure die castings are relatively expensive.

SUMMARY OF THE INVENTION

It is a object of the assembly to provide a base plate assembly which is of the kind described first hereinbefore and in which the means permitting a transverse displacement of the cover plate relative to the base plate are so simple that the assembly can be manufactured with a low expenditure which justifies mass production.

In a base plate of the kind described first hereinbefore that object is accomplished in accordance with a first aspect of the invention in that the retaining means consist of a rivet, which has a manufactured head and a shank that is riveted to the base plate or the cover plate and extends through a second slot, which is formed in the respective other plate to which the shank is not riveted and which second slot is parallel to the direction in which the cover plate is guided on the base plate, and the diameter of the manufactured head exceeds the width of the second slot.

In the base plate assembly in accordance with the invention the base plate and the cover plate are connected in a simple manner and with low manufacturing costs by a retaining rivet and by a fixing screw, which extend through slots in the cover plate and are respectively riveted to and screwed into the base plate so that the two plates are transversely movable relative to each other and can be fixed to each other in a simple manner.

In a desirable embodiment the base plate and the cover plate are formed each with lateral extensions so that each of said plates is substantially cross-shaped, the rivet is secured to the underside of an intermediate portion of the cover plate, which intermediate portion carries the hinge bracket, the rivet extends through a slot in the base plate, and the thin manufactured head is disposed in a groove, which surrounds the slot and is defined by an annular step and has side faces having a height that exceeds the thickness of the retaining head.

In a desirable embodiment the fixing screw extends through a slot formed at the lower end of the intermediate portion of the cover plate. That embodiment affords the advantage that the lateral extensions of the base plate can be formed with bores for receiving fixing screws having heads disposed in slots which are formed in the lateral extensions of the cover plate in an arrangement in which the width of the lastmentioned slots exceeds the diameter of the heads of the fixing screws. In that case the fixing screws can be inserted through the bores in the base plate into predrilled holes in the furniture part and can then be tightened and the access to said screws will not be obstructed by the cover plate lying over the base plate.

In another embodiment of the invention the cover plate is provided on the underside with an annular flange and the flanges at the side portions of the cover plate define channels for guiding the side portions of the base plate. A a result, the cover plate is guided on the base plate for an exact transverse displacement. It will be understood that the intermediate portion of the base plate must have a smaller width than the intermediate portion of the base plate so that the desired transverse displacement will not be obstructed. Besides, the lateral extensions of the cover plate are so much longer than the lateral extensions of the base plate that the desired transverse displacement is permitted.

In a desirable embodiment the rivet has an annular shoulder, which is succeeded by a reduced end portion, which is riveted in that bore of the cover plate which serves to retain the rivet, and the annular shoulder bears on a rim which is constituted by an oppositely facing annular shoulder. In the assembling of the parts of such an assembly it is simple to ensure that the cover plate is retained on the base plate between the latter and the manufactured head of the rivet with an adequate clearance so that the cover plate can easily be transversely displaced.

The rivet head is suitably disposed in an enlarged top portion of the bore in the cover plate, which enlarged portion is defined by an annular step. In that case the rivet can be fixed to the cover plate in a simple manner in that the rivet is riveted to the cover plate.

The bore for retaining the rivet suitably extends through a projection which is provided on the intermediate portion of the cover plate and serves to mount the hinge bracket. In that case the bore will be long and will ensure that the rivet will be satisfactorily retained.

In another embodiment the rivet may be riveted to the base plate.

In a further embodiment of the invention the rivet is riveted to a lateral extension of the base plate, the lateral extensions of the cover plate are formed with slots extending transversely to the longitudinal center line, the shank of the rivet, which shank carries the manufactured head, as well as the clamp screw extend through respective ones of said slots, and the clamp screw is screwed into a tapped bore of the other lateral extension of the base plate.

In a suitable embodiment the shank of the rivet has a reduced end portion, which adjoins a step formed by an annular shoulder, said reduced end portion is riveted in a bore of one lateral extension of the base plate, and the shank has between the annular shoulder and the manufactured head a relatively thick portion in a length which exceeds the thickness of the cover plate.

In a second aspect of the invention the object set forth is accomplished in that the retaining means consist of a screw, which is adapted to be screwed into the base plate or which extends through a bore in the base plate and is adapted to be screwed into the carrying wall or the like, and said screw has below its head a collar, which is thicker than the shaft of the screw and extends through the cover plate in a second slot, which is parallel to the first-mentioned slot, said collar has a lower annular step, which bears on the rim of the tapped or through bore in the base plate, and the axial length of said collar exceeds the thickness of the second slot. In accordance with said second aspect the base plate assembly is even simpler than the assembly provided by the invention in its first aspect because the retaining means are constituted only by a screw which is provided with a collar and preferably serves also to fix the base plate assembly. If the retaining means consist of a screw for fixing the base plate assembly, that screw may be screwed into the carrying wall or the like directly or by means of a plug.

The slots preferably extend in the elongate intermediate portion of the cover plate. They may suitably extend on the longitudinal center line of the cover plate. For this reason the tapped or through bores for receiving the clamp screw and/or the fixing screws are suitably also provided on the longitudinal center line of the base plate.

The slots are suitably provided in the forward and rear portions of the cover plate.

In another embodiment of the invention, at least one elevation which provides a fulcrum for a rocker is provided on one of the confronting broadsides of the base plate and cover plate and is disposed between the slots. In that embodiment a clamp screw having a collar can be inserted through a through bore in the cover plate and can be screwed into a tapped bore in the base plate so as to initially provide for an axial play of the cover plate between the head of said clamp screw and the base plate and said axial play can subsequently be eliminated in that said clamp screw is tightened to force the base plate against the underside of the head of said screw.

The elevation suitably consists of a rib which is approximately parallel to the slots.

BRIEF DESCRIPTION OF THE DRAWING

FIG. 7 is a bottom base plate assembly, which base plate has been separated from the cover plate.

FIG. 8 is a central longitudinal sectional view showing the base plate of FIG. 7.

FIG. 9 is a side elevation showing the rivet before it has been riveted.

FIG. 10 is a top plan view showing the cover plate of the second embodiment.

DETAILED DESCRIPTION OF THE PREFERRED EMBODIMENTS

Figure 1:
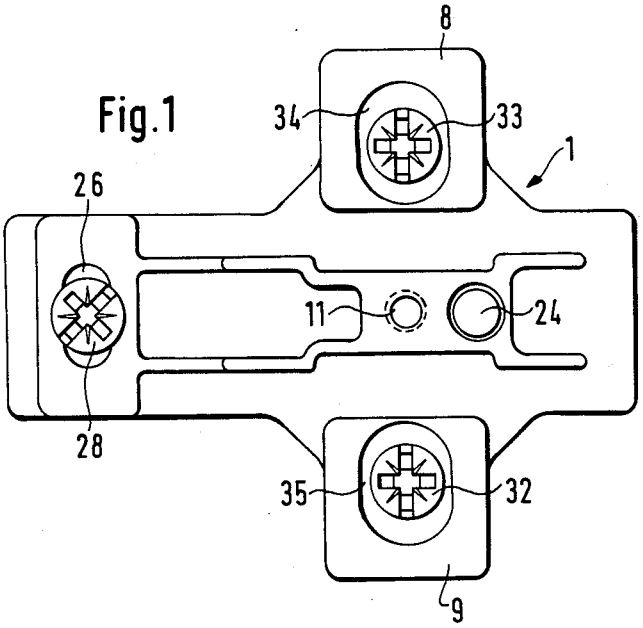
FIG. 1 is a top plan view showing a base plate assembly for a hinge bracket of a furniture hinge, which assembly consists of a base plate and a cover plate secured to the base plate.
Figure 2:
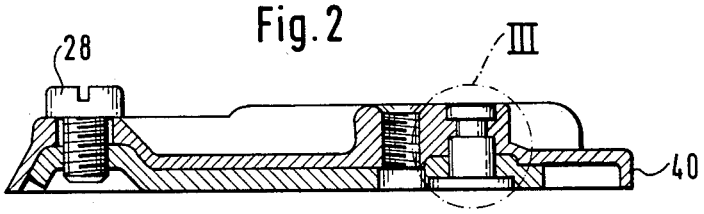
FIG. 2 is a central longitudinal sectional view showing the cover plate of FIG. 1.

Illustrative embodiments of the invention will now be explained more in detail with reference to the drawing.

In the embodiment shown in FIGS. 1 to 6 the base plate assembly 1 comprises a base plate 2 and a cover plate 3 which covers the base plate 2. The base plate 2 is cross-shaped and has an elongate intermediate portion 4 and lateral extensions 5, 6. The cover plate 3 is also cross-shaped and also comprises a relatively long intermediate portion 7 and lateral extensions 8, 9. The intermediate portion 7 of the cover plate 3 is provided with an elongate projection 10, which serves to guide the hinge bracket and is used to secure the latter. The hinge bracket is channel-shaped and embraces the projection 10. The solid intermediate portion of the projection 10 is formed with a tapped bore 11 for receiving a screw for fixing the hinge bracket and is formed also with a bore 12 in which the rivet 13 has been riveted.

Figure 3:
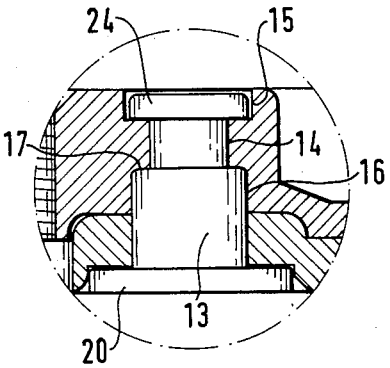
FIG. 3 shows on a larger scale also in section the rivet-containing region of the cover plate of FIG. 2.
Figure 4:
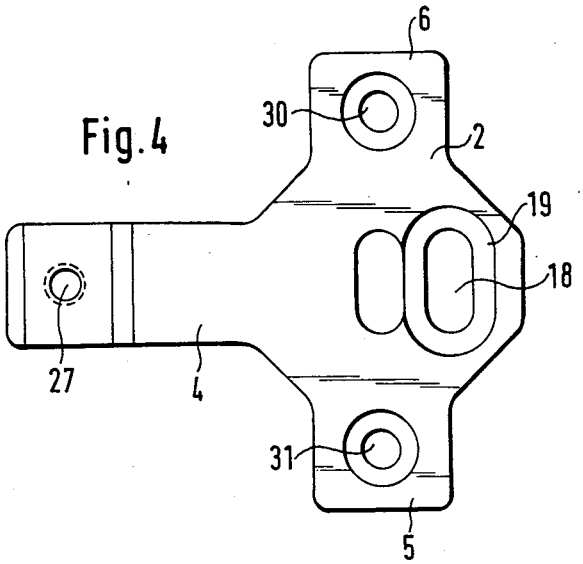
FIG. 4 is a bottom plan view showing the base plate which has been separated from the cover plate.
Figure 5:
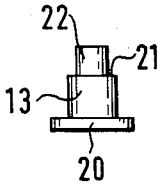
FIG. 5 is a side elevation showing the rivet before it has been riveted.
Figure 6:
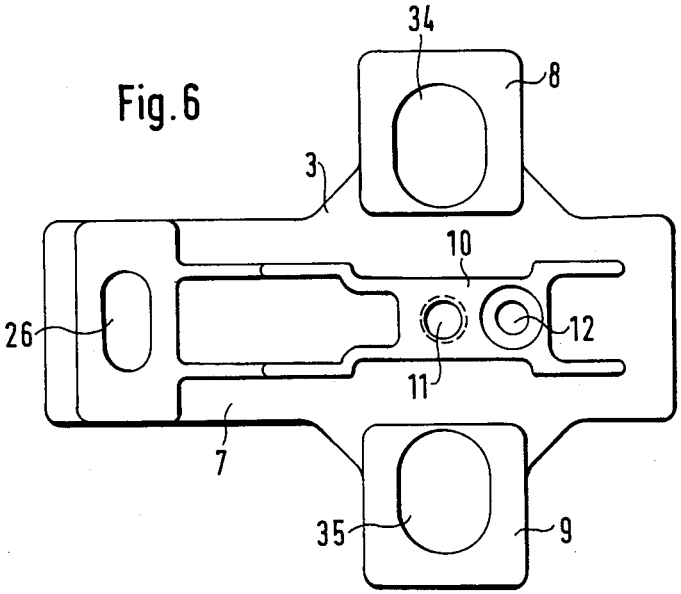
FIG. 6 is a top plan view showing the cover plate which has been separated from the base plate.
Figure 11:
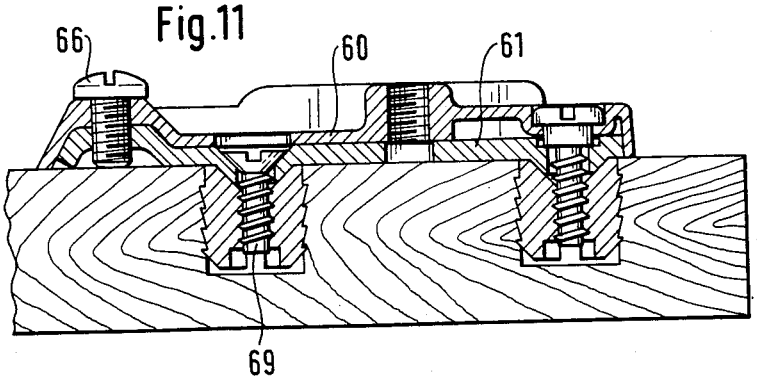
FIG. 11 is a central longitudinal sectional view showing a third embodiment of a base plate assembly.
Figure 12:
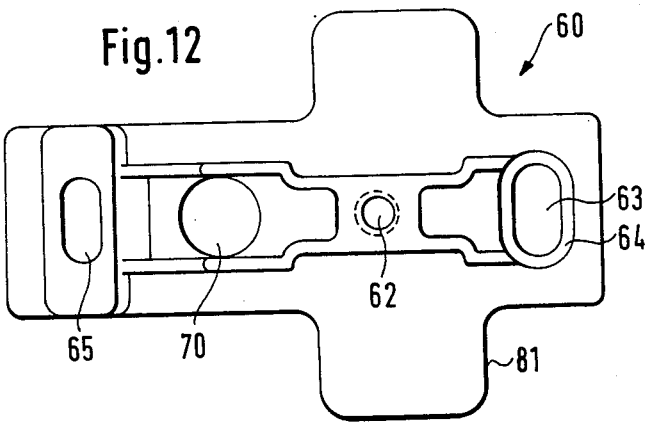
FIG. 12 is a top plan view showing the cover plate of the base plate assembly of FIG. 11.
Figure 13:
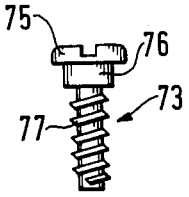
FIG. 13 is a side elevation showing the fixing screw which is provided with a collar.
Figure 14:
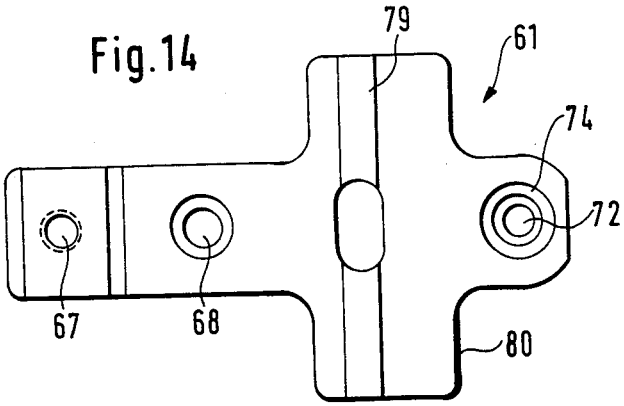
FIG. 14 is a top plan view showing the base plate assembly of FIG. 11.

As is apparent from FIG. 3 the bore 12 has an intermediate portion 14 which is relatively small in diameter and which is adjoined via step-forming annular shoulders by enlarged bore portions 15, 16. The rivet 13 used to connect the base plate 2 to the cover plate 3 extends through a slot 18, which is formed in the forward end portion of the intermediate portion 4 of the base plate 2. The slot 18 is formed on its underside with a stepped annular edge portion 19, which virtually defines a groove, which contains the thin manufactured head 20 of the rivet 13. The rivet 13 has a reduced end portion 22, which adjoins a step-forming annular shoulder 21 and extends in the bore 12 of the cover plate in that intermediate bore portion 14 which is smallest in diameter. The annular shoulder 21 of the rivet 13 bears on the annular shoulder 17 of the bore 12 in the cover plate 3.

In the enlarged top portion 15 of the bore 12 the reduced shank portion 22 of the rivet 13 has been riveted to form a rivet head 24. That rivet head 24 is so thin that it does not protrude beyond the enlarged bore portion 15 formed in the projection 10. The annular shoulders 21 and 17 of the rivet 13 of the bore 12 in the cover plate 3, respectively, are so matched that there is an adequate clearance amounting to, e.g., 0.1 to 0.2 mm between the manufactured head 20 of the rivet 13 and the cover plate 3 so that the cover plate can easily be transversely displaced on the base plate 2.

At the lower end of the cover plate 3 the intermediate portion 7 of the cover plate 3 comprises a relatively thick region, which is formed with a slot 26 that is parallel to the slot 18 in the base plate. The intermediate portion 4 of the base plate 2 is formed with a tapped bore 27, which is aligned with the intermediate portion of the slot 6 into which the fixing screw 28 has been screwed in the manner shown in FIGS. 1 and 2.

The lateral extensions of the base plate 2 are formed with bores 30, 31 for receiving fixing screws 32, 33. The lateral extensions 9, 8 of the cover plate 3 are formed with slots 34, 35, and the bores 30, 31 of the base plate 2 register with the slots 34, 35. When it is desired to fix the base plate 2 to a furniture part or the like, the fixing screws 32, 33 can be screwed into the furniture part or the like and this will not be obstructed by the cover plate because the width of the slots 34, 35 in the cover plate 3 exceeds the diameter of the heads of the fixing screws 32, 33, as is apparent from FIG. 1.

The cover plate is provided with a depending annular flange 40, which adjacent in the lateral extensions 8, 9 defines channels for guiding the lateral extensions 5, 6 of the base plate.

In the illustrative embodiment shown in FIGS. 7 to 10 the rivet 41 has an end portion 43 which adjoins the annular shoulder 42 and is reduced in diameter and that end portion 43 has been riveted in the bore 44 of one lateral extension 45 of the base plate 46. The other lateral extension 47 is formed with a tapped bore 48. The intermediate portion 49 of the base plate 46 is formed in its upper and lower end regions with plugs 50, 51, which are driven into predrilled fixing bores in a furniture part or the like.

In the base plate assembly composed of the components shown in FIGS. 7 to 10 that shank portion 55 of the rivet 41 which is larger in diameter extends through the slot 58 in the lower lateral extension 56 of the cover plate 57. The width of the slot 58 matches the diameter of the thicker shank portion 55 of the rivet 41. The manufactured head 59 of the rivet 41 overlaps the edge portions which define the slot 58. A clamp screw, not shown, extends through the slot **60*a* formed in the other lateral extension 61*a* of the cover plate 27 and has been screwed into the tapped bore 48 of the lateral extension 47 of the base plate 46**.

The annular shoulder 42 of the rivet 41 bears on the edge that defines the bore 44 which receives the rivet. The length of the enlarged shank portion 55 slightly exceeds the thickness of the cover plate 57 adjacent to the slot so that a slight transverse displacement is permitted.

In the manner described with reference to the first embodiment the lateral extensions 45, 47 of the base plate 46 are guided in guiding channels defined in the lateral extensions **56, 61*a* of the cover plate 57** by depending flanges, which are not shown.

In the third embodiment shown in FIGS. 11 to 14 the base plate assembly consists also of a base plate 61 and a cover plate 60, which covers the base plate 61 at least in part and has an H-shaped raised intermediate portion or projection that is formed with a tapped bore for fixing the hinge bracket or an intermediate plate. The cover plate 60 is formed adjacent to the forward end of its intermediate portion the cover plate 60 with a slot 63 and is formed at the upper edge of said slot 63 with an offset annular step 64. In the rear region of its elongate intermediate portion the cover plate 60 is formed with a slot 65. An adjusting screw 66 extends through the slot 65 and has been screwed into a tapped bore 67 of the base plate 61.

The base plate 61 is formed with a through bore 68, which receives a fixing screw 69, which is accessible through a bore 70 in the cover plate 60. The base plate 61 is also formed with a bore 72 for receiving a second fixing screw 73. The upper edge portion defining the bore 72 is formed with an annular peripheral step 74.

The head 75 of the fixing screw 73 is adjoined by a collar 76, which is wider than the screw-threaded shaft 77. When the assembly has been completed the lower edge of the collar 76 bears on the annular step 74, which constitutes the edge portion of the bore 72 of the base plate 61. The collar 76 has such an axial length that in the completed assembly the distance between the head of the screw 76 and the base plate 61 will be so large that the cover plate 60 can easily be transversely displaced relative to the base plate 61. The axial play of the cover plate relative to the overlapping head and the base plate 61 may initially amount to about 0.1 to 0.2 mm, for instance.

Between the two bores 67 and 72 the base plate 61 is formed with a rib 79, which is parallel to the slots 63, 65 in the cover plate 60 and which constitutes a fulcrum for a rocker. As the adjusting screw 7 is screwed in as far as possible, the stepped edge portion 64 defining the slot 63 will be forced against the lower rim of the head 75 of the screw 73 so that the play which was required for the diplacement of the plates 60, 61 relative to each other is eliminated.

In the embodiment shown in FIGS. 11 to 14, the plates 60 and 61 are guided relative to each other by the sliding engagement between the edges 80 of the base plate 81 and the confronting inside surfaces of the edge flanges 81 of the cover plate 60. The wing-like extensions of the base plate 61 and of the cover plate 60 may be omitted because the guidance may be effected, e.g., by the sliding engagement between the corresponding rear and front portions of such plates.

The screws 69, 73 can be directly screwed into a furniture wall or, as shown, may be screwed into plugs that have been inserted into such wall.

I claim:

1. A base plate assembly for mounting a hinge bracket of a furniture hinge, said base plate assembly comprises a base plate, which is adapted to be secured to a carrying wall by mechanical fastners, and a cover plate having an elongated projection, said cover plate at least partly covers the base plate and is guided on the same transversely to the elongated projection and provided with means for fixing the hinge bracket, the cover plate is connected to the base plate by retaining means and by a headed clamp screw, the headed clamp screw is screwed into a tapped bore in the base plate and extends through a slot that is formed in the cover plate and is parallel to the direction in which the cover plate is guided on the base plate, characterized in that the retaining means consist of a rivet, which has a manufactured head and a shank that is riveted to one of the base plate and the cover plate and extends through a second slot, which is formed in the respective other plate to which the shank is not riveted and said second slot is parallel to the direction in which the cover plate is guided on the base plate, and the diameter of the manufactured head exceeds the width of the second slot, further characterized in that the clamp screw extends through a slot formed at a lower end of the intermediate portion of the cover plate.

2. A base plate assembly according to claim 1, characterized in that the base plate and the cover plate are formed each with lateral extensions so that each of said plates is substantially cross-shaped, the rivet is secured to the underside of an intermediate portion of the cover plate, said intermediate portion carries the hinge bracket, the rivet extends through a slot in the base plate, and the manufactured head is disposed in a groove, which surrounds the slot and is defined by an annular step and has side faces having a height that exceeds the thickness of the head.

3. A base plate assembly according to claim 1, characterized in that the base plate and the cover plate are formed each with lateral extensions so that each of said plates is substantially cross-shaped, and the lateral extensions of the base plate are formed with bores for receiving fixing screws having heads disposed in slots which are formed in the lateral extensions of the cover plate in an arrangement in which the width of the slots exceeds the diameter of the heads of the fixing screws.

4. A base plate according to claim 1, characterized in that the cover plate is provided on the underside with an annular flange and the flanges at the side portions of the cover plate define channels for guiding the side portions of the base plate.

5. A base plate assembly according to claim 1, characterized in that the rivet has an annular shoulder, which is succeeded by a reduced end portion, which is riveted in the bore of the cover plate which serves to retain the rivet, and the annular shoulder bears on a rim which is constituted by an oppositely facing annular shoulder.

6. A base plate assembly according to claim 1, characterized in that the rivet head is disposed in an enlarged top portion of the bore in the cover plate, said enlarged portion is defined by an annular step.

7. A base plate assembly according to claim 6, characterized in that the bore for retaining the rivet extends through the projection which is provided on the intermediate portion of the cover plate and serves to mount the hinge bracket.

8. A base plate assembly according to claim 1, characterized in that the rivet is riveted to the base plate.

9. A base plate assembly according to claim 8, characterized in that the base plate and the cover plate are formed each with lateral extensions so that each of said plates is substantially cross-shaped, the rivet is riveted to a lateral extension of the base plate, the lateral extensions of the cover plate are formed with slots extending transversely to the longitudinal center line, the shank of the rivet, said shank carries the manufactured head, as well as the clamp screw extend through respective ones of said slots, and the clamp screw is screwed into a tapped bore of the other lateral extension of the base plate.

10. A base plate assembly for mounting a hinge, bracket of a furniture hinge, said base plate assembly comprises a base plate, which is adapted to be secured to a carrying wall by mechanical fastners, and a cover plate, which at least partly covers the base plate and is guided on the same transversely to the hinge bracket and provided with means for fixing the hinge bracket, the cover plate is connected to the base plate by retaining means and by a headed clamp screw, the headed clamp screw is screwed into a tapped bore in the base plate and extends through a slot that is formed in the cover plate and is parallel to the direction in which the cover plate is guided on the base plate, characterized in that the retaining means consist of a rivet, which has a manufactured head and a shank that is riveted to one of the base plate and the cover plate and extends through a second slot, which is formed in the respective other plate to which the shank is not riveted and said second slot is parallel to the direction in which the cover plate is guided on the base plate, and the diameter of the manufactured head exceeds the width of the second slot, further characterized in that the rivet is riveted to the base plate, and still further characterized in that the base plate and the cover plate are formed each with lateral extensions so that each of said plates is substantially cross-shaped, the shank of the rivet has a reduced end portion, which adjoins a step formed by an annular shoulder, said reduced end portion is riveted in a bore of one lateral extension of the base plate, and the shank has between the annular shoulder and the manufactured head a relatively thick portion in a length which exceeds the thickness of the cover plate.

11. A base plate assembly for mounting a hinge bracket of a furniture hinge, said base plate assembly comprises a base plate, which is adapted to be secured to a carrying wall by mechanical fasteners, and a cover plate, which at least partly covers the base plate and is guided on the same transversely to the hinge bracket or the like and provided with means for fixing the hinge bracket, the cover plate is connected to the base plate by retaining means and by a headed clamp screw, the headed clamp screw is screwed into a tapped bore in the base plate and extends through a first slot that is formed in the cover plate and is parallel to the direction in which the cover plate is guided on the base plate, characterized in that the retaining means consist of a screw, which is adapted to be screwed into one of the base plate and the carrying wall through a bore in the base plate, and said screw has below its head a collar, which is thicker than the shaft of the screw and extends through the cover plate in a second slot, which is parallel to the first slot, said collar has a lower annular step, which bears on the rim of the tapped bore in the base plate, and the axial length of said collar exceeds the thickness of the second slot.

12. A base plate assembly according to claim 11, characterized in that the slots in the cover plate extend adjacent to the elongate intermediate portion of the cover plate.

13. A base plate assembly according to claim 11, characterized in that the slots in the cover plate are formed in the forward and rear portions of the cover plate.

14. A base plate assembly according to claim 11, characterized in that at least one elevation which provides a fulcrum for a rocker is provided on one of the confronting broadsides of the base plate and cover plate and is disposed between the slots.

15. A base plate assembly according to claim 14, characterized in that the elevation consists of a rib which is approximately parallel to the slots.

* * * * *